US005533426A

United States Patent [19]

Morales

[11] Patent Number: 5,533,426

[45] Date of Patent: Jul. 9, 1996

[54] STUD REMOVAL AND FASTENING TOOL

[76] Inventor: Emmitt Morales, 5260 Stardust Dr., Beaumont, Tex. 77706

[21] Appl. No.: 372,609

[22] Filed: Jan. 13, 1995

[51] Int. Cl.[6] ..... B25B 13/12

[52] U.S. Cl. ..... 81/53.2; 81/179

[58] Field of Search ..... 81/53.2, 128, 179, 81/186

[56] References Cited

U.S. PATENT DOCUMENTS

| | | | |
|---|---|---|---|
| 1,169,551 | 1/1916 | McCroba | 81/179 |
| 5,315,902 | 5/1994 | Ragland et al. | 81/53.2 |

FOREIGN PATENT DOCUMENTS

| | | | |
|---|---|---|---|
| 565376 | 11/1944 | United Kingdom | 81/179 |

*Primary Examiner*—Bruce M. Kisliuk
*Assistant Examiner*—Joni B. Danganan
*Attorney, Agent, or Firm*—Harrison & Egbert

[57] ABSTRACT

The tool has a socket with an opening leading to a cavity with a plurality of straight inner side walls spaced about a longitudinal axis. A plurality of wedge shaped jaws equal in number to the plurality of inner side walls are removably located in the cavity. Each jaw has a straight outer beating surface, and an inner gripping surface. Spaced apart opposite end wall member with central openings are provided for slidably supporting the jaws for movement between closed and open positions along straight paths with each bearing surface engaging an inner side wall of the socket when the jaws are located in the cavity. Guides are provided for guiding the jaws for movement along their straight paths. Springs are provided for normally urging the jaws to their closed positions and allowing a threaded member to be inserted between the jaws. The jaws are held in the cavity such that when a threaded member is located between the jaws, rotation of the socket in given direction causes the side walls of the socket to apply rotational torque to the outer beating surfaces of the jaws to cause the gripping surfaces of the jaws to grip and rotate the threaded member. The jaws may be reversed in position to allow the tool to unscrew or screw a threaded member from or into a threaded aperture.

9 Claims, 5 Drawing Sheets

STUD REMOVAL AND FASTENING TOOL

BACKGROUND OF THE INVENTION

1. Field of the Invention

This invention relates to a tool for removing or screwing a threaded member such as a stud from or into a threaded aperture.

2. Description of the Prior Art

U.S. Pat. Nos. 4,932,292 and 5,152,195 and U.S. patent application Ser. No. 07/980,672, filed Nov. 24, 1992, disclose different types of stud removing tools.

SUMMARY OF THE INVENTION

It is an object of the invention to provide a new and useful tool which can be used to remove or screw studs or other threaded members from or into a threaded aperture.

It is another object of the invention to provide a tool for applying rotational force to a threaded member which allows for a greater range of different size and configured jaws for engaging and rotating the threaded member.

The tool of the invention comprises a socket having a surrounding wall defining an opening leading to a cavity with a plurality of inner side walls spaced about a longitudinal axis extending through the cavity. A plurality of jaws equal in number to the plurality of inner side walls are adapted to be located in the cavity. Each jaw has opposite facing edges, an outer beating surface, and an inner gripping surface with each jaw being wedge shaped in cross-section through its outer and inner surfaces. Spaced apart opposite end wall members with central openings are provided for slidably supporting the opposite edges of the jaws for movement between closed and open positions along straight paths with each beating surface engaging an inner side wall of the socket when the jaws are located in the cavity with an opening formed between the gripping surfaces of the jaws for receiving a threaded member. Guide means are provided for guiding the jaws for movement along the linear paths. Tension means is provided for normally urging the jaws to their closed positions and allowing a threaded member to be inserted between the jaws. Means is provided for holding the jaws in the cavity such that when a threaded member is located between the jaws, rotation of the socket in a given direction causes the side walls of the socket to apply rotational torque to the outer beating surfaces of the jaws to cause the gripping surfaces of the jaws to grip and rotate the threaded member.

The jaws may be reversed in position to allow the tool to unscrew or screw a threaded member from or into a threaded aperture.

In one embodiment, the two wall members are spaced apart by rods and have aligned guide slots forming a cartridge for supporting the jaws. The jaws have apertures formed therethrough through which guide rods are inserted and located in the aligned slots for guiding movement of the jaws between the two wall members. The cartridge may be reversed in position in the cavity of the socket to allow the tool to screw or unscrew a threaded member.

In another embodiment, the two wall members have aligned guide surfaces for engaging slide surfaces formed on opposite edges of the jaws for guiding movement of the jaws between the two wall members. In this embodiment the socket has opposite ends with an opening at each end leading to the cavity and the two wall members are secured to the opposite ends of the socket with their guide surfaces facing inward.

BRIEF DESCRIPTION OF THE DRAWINGS

In FIG. 8 the serrated chamfered edges of the jaws are not shown.

DESCRIPTION OF THE PREFERRED EMBODIMENTS

Figure 1:
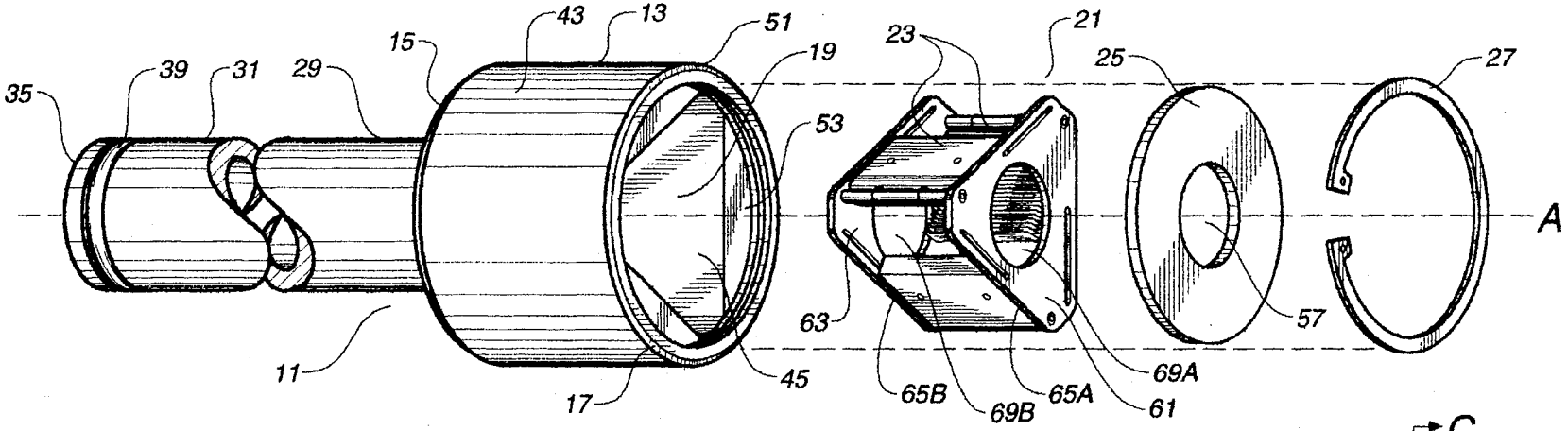
FIG. 1 is an exploded isometric view of one embodiment of the stud removing tool of the present invention.
Figure 2:
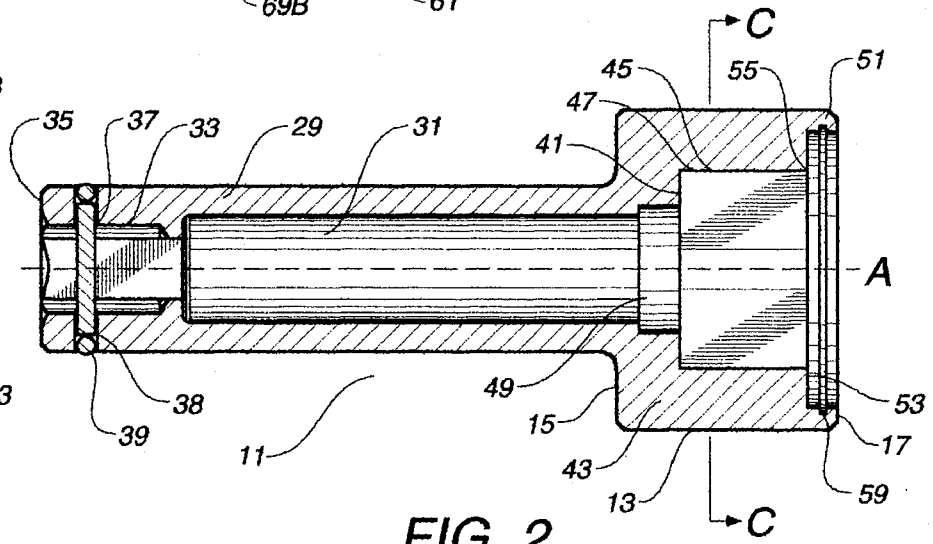
FIG. 2 is a side cross-sectional view of the stud removing tool of FIG. 1.
Figure 4:
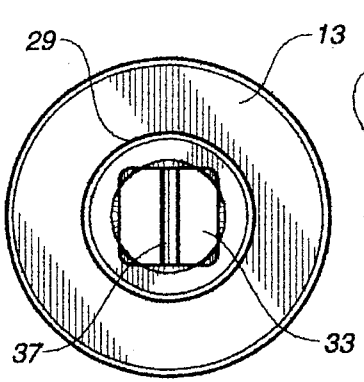
FIG. 4 is a bottom view of the stud removing tool of FIG. 1.
Figure 3:
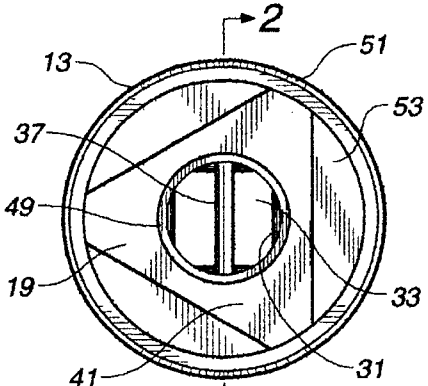
FIG. 3 is a top view of the stud removing tool of FIG. 1.
Figure 5:
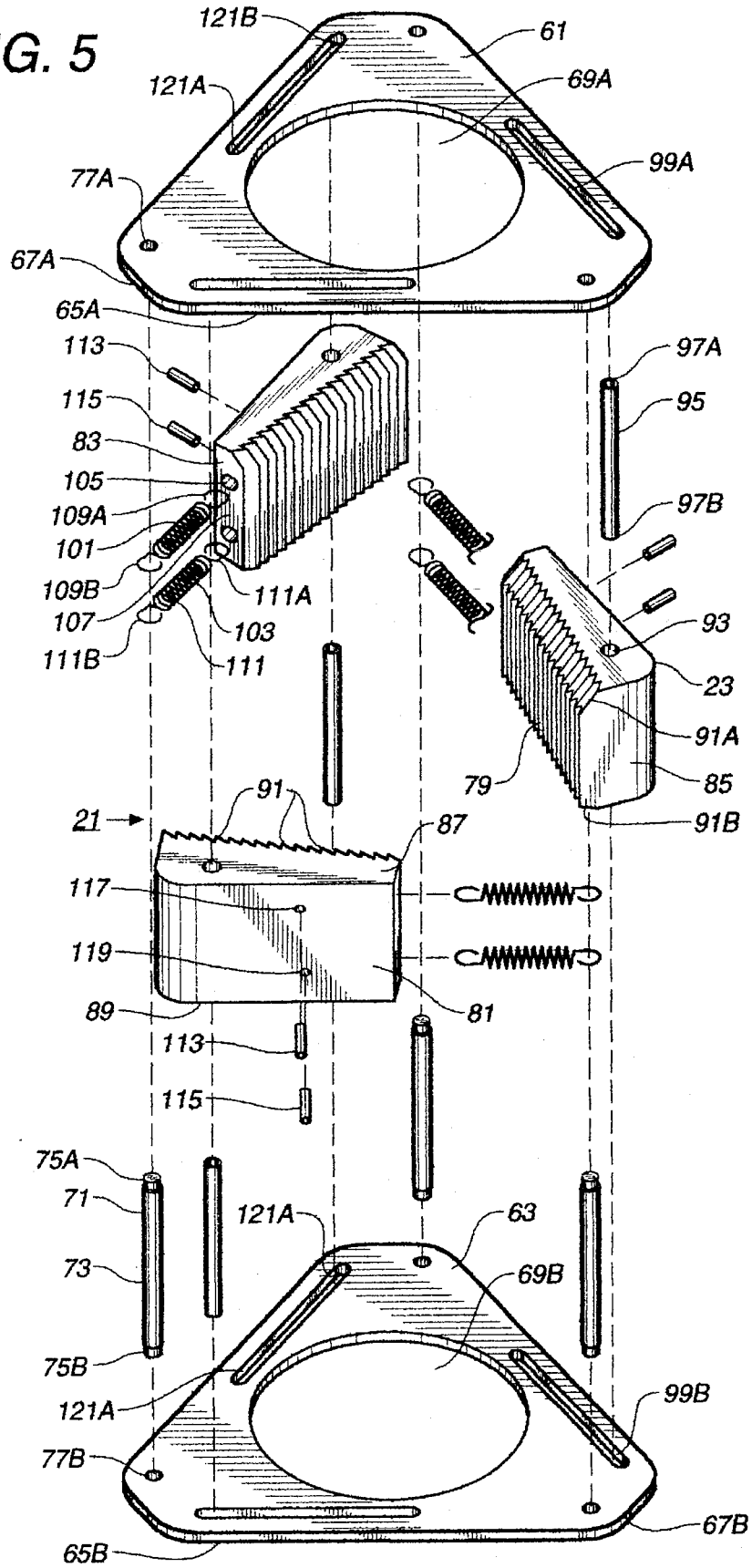
FIG. 5 is an exploded view of the cartridge of the stud removing tool of FIG. 1.

Referring now to FIGS. 1–4, the tool 11 has a cylindrical socket housing 13 having a longitudinal axis A extending between a shank end 15 and an open end 17 of the housing. A cavity 19 is formed in the housing extending along axis A. The open end 17 of the housing 13 is open to permit access to the cavity 19 by a stud 20 (See FIGS. 6 and 7). A cartridge 21 containing retractable gripping jaws 23 is located in the cavity 19 so that the gripping jaws 23 are located about the axis A in a position to grip a stud extending into the cavity 19. The cartridge 21 is held within the socket housing 13 by a retaining plate 25 secured about the open end 17 of the housing with a snap ring 27.

A hollow tubular shank 29 is coupled to the shank end 15 of the socket housing 13 extending co-axially with the housing. The shank 29 has a cylindrical bore 31 that extends along axis A substantial portion of the length of the shank. A polygonal recess 33 in communication with the cylindrical bore 31 is formed at a coupling end 35 of the shank for receiving a polygonal rotary drive shank of a driver (not shown) such as an air impact wrench. The driver may be secured to the shank 29 by a pin 37 which extends through an aperture 38 formed through the wall of the shank 29 and through an aperture (not shown) formed through rotatory drive shank. The pin 37 is removably secured in the shank extending through polygonal recess 33 by a removable elastic, O-ring 39 located about the circumference of the shank 29 at the coupling end 35 of the shank. The driver may be used to rotate the shank 29, socket housing 13, and cartridge 21 to loosen or tighten a stud located in the cavity 19.

The cartridge 21 is located in the cavity 19 of socket housing 13 supported by shoulder 41. The socket housing 13 comprises a cylindrical body 43 having a polygonal inner wall 45 comprising three straight or linear inner side walls 45W that extend about and define the cavity 19. The shoulder 41 extends transversely inward from inner wall 45 toward the axis A of the housing 13 to a cylindrical collar bore 49. The collar bore 49 extends to the cylindrical bore 31 of the shank 29. The cartridge 21 fits into the cavity 19 within the polygonal inner wall 45 of the housing 13 with the sides of the cartridge extending adjacent the inner wall 45 and the bottom of the cartridge located on shoulder 41.

The cartridge 21 is secured in the cavity 19 of socket housing 13 by retaining plate 25 and a resilient snap ring 27. The socket housing 13 has a cylindrical lip 51 extending about the open end 17 of the housing along about the circumference of the shank 29 at the coupling end 35 of the shank. The driver may be used to rotate the shank 29, socket housing 13, and cartridge 21 to loosen or tighten a stud located in the cavity 19.

The cartridge 21 is located in the cavity 19 of socket housing 13 supported by shoulder 41. The socket housing 13 comprises a cylindrical body 43 having a polygonal inner wall 45 comprising three straight or linear inner side walls 45W that extend about and define the cavity 19. The shoulder 41 extends transversely inward from inner wall 45 toward the axis A of the housing 13 to a cylindrical collar bore 49. The collar bore 49 extends to the cylindrical bore 31 of the shank 29. The cartridge 21 fits into the cavity 19 within the polygonal inner wall 45 of the housing 13 with the sides of the cartridge extending adjacent the inner wall 45 and the bottom of the cartridge located on shoulder 41.

The cartridge 21 is secured in the cavity 19 of socket housing 13 by retaining plate 25 and a resilient snap ring 27. The socket housing 13 has a cylindrical lip 51 extending about the open end 17 of the housing along the circumference of the housing. A shelf or shoulder 53 extends transversely from the lip 51 inward to an open end 55 of the inner wall 45. Retaining plate 25 is located on the shelf 53 over the cartridge 21 located in cavity 19 to hold the cartridge within the cavity. A central opening 57 extends through the retaining plate 25 about axis A so that a stud may be inserted into the cavity 19 through the opening 57 of the retaining plate 25. Snap ring 27 is removably located in annular groove 59 in the lip 51 over the retaining plate 25 to removably secure the retaining plate 25 in the housing 13.

Referring now to FIGS. 5–8, cartridge 21 is shown in detail. The cartridge 21 is comprised of gripping jaws 23 located between cartridge plates 61, 63. Each plate 61 and 63 has an identical polygonal shape structured so that sides 65A, 65B of the respective plates 61, 63 are located extending adjacent the inner walls 45W of the housing 13 when cartridge 21 is located in cavity 19 (See FIG. 1). In one embodiment, each plate 61 and 63 has a substantially equilateral triangular shape having three straight or linear sides 65A, 65B respectively, joined by rounded corners 67A and 67B.

Central apertures 69A and 69B extend through the plates 61 and 63, respectively. The central apertures 69A, 69B permit a stud 20 to be inserted into the cartridge 21. The central apertures 69A, 69B of the plates 61, 63 are located in the plates so that the axis A of the socket housing 13 extends centrally through the apertures 69A, 69B when cartridge 21 is located in cavity 19 (See FIG. 1).

Cylindrical support rods 71 extend transversely between the upper and lower plates 61 and 63 to couple the plates in an aligned spaced apart relationship. The body 73 of each support rod 71 extends between and spaces the plates 61 and 63 apart. The ends 75A, 75B of each support rod 71 have smaller diameters than the body 73 of the support rod so the ends 75A and 75B removably fit into opposing apertures 77A and 77B formed through the plates 61 and 63 respectively, and removably couple the plates 61 and 63 together with the body 73 of the support rod spacing the plates 61, 63 apart.

Three identical gripping jaws 23 are provided between the spaced apart plates 61 and 63 for co-operatively gripping a stud 20 to tighten or loosen the stud 20 when the stud is located in the socket housing 13 and the housing is rotated about the stud. Each gripping jaw 23 is a wedge shaped block having a gripping face 79 and a straight or linear slidable face 81 joined by a narrow end 83, a wide end 85, and opposite edges 87 and 89. The gripping face 79 extends at an acute angle with respect to the face 81 and has a plurality of ridged teeth 91 extending along the gripping face 79 for gripping a stud 20. The teeth point toward the wide end 85 of the jaw. Each jaw 23 has chamfered or beveled edges 91A and 91B formed between the teeth 91 and the edges 87 and 89. The edges 91A and 91B are serrated.

Figure 6:
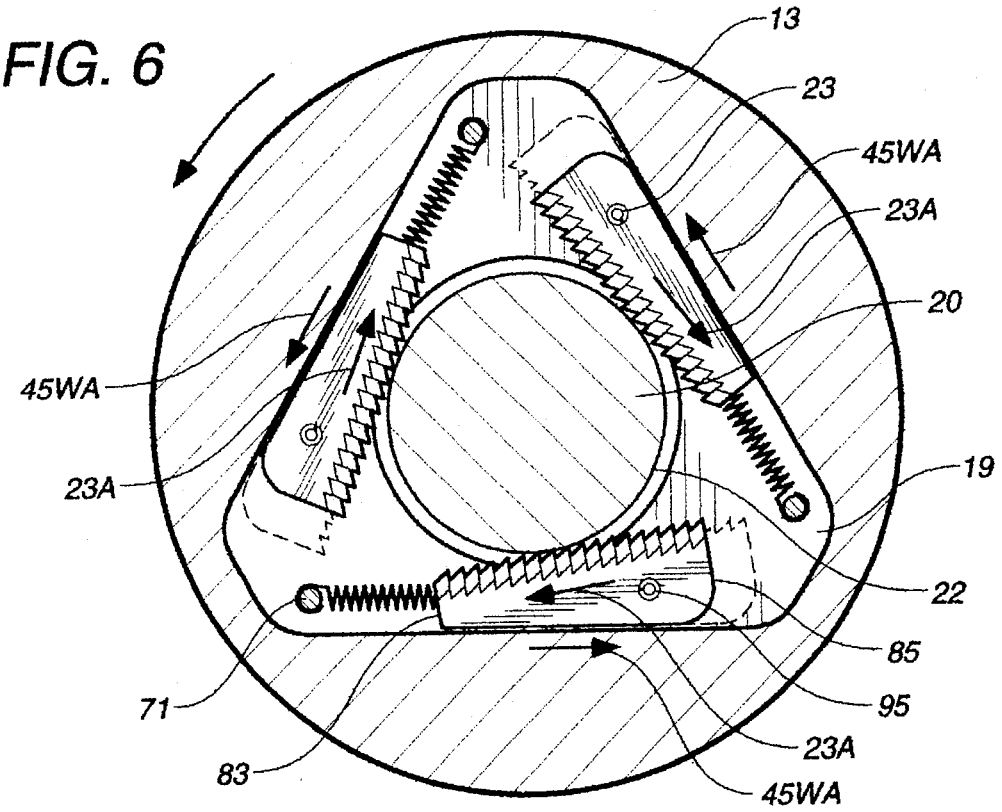
FIG. 6 is cross-sectional view of the socket housing and cartridge located about a stud in a position to loosen a stud. The cross section of FIG. 6 is taken along lines C—C of FIG. 2 with the cartridge located in the socket in a position to unscrew a stud. The socket housing is shown being rotated relative to the stud to loosen the stud.
Figure 7:
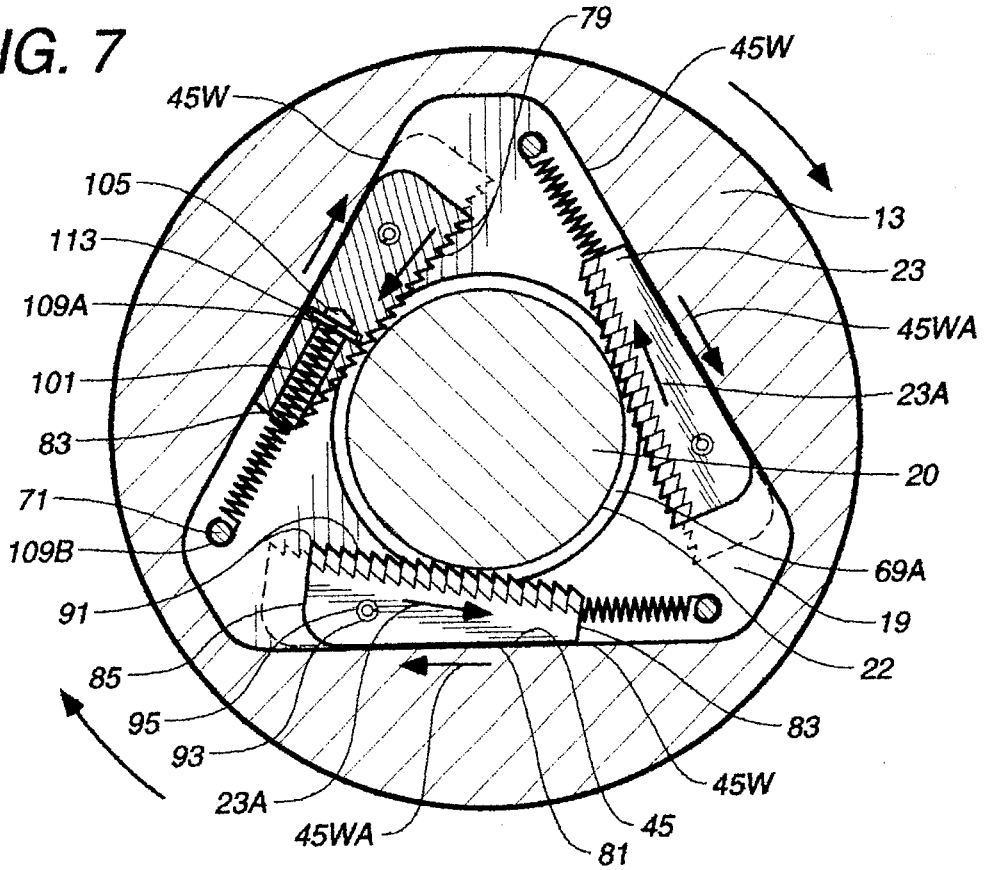
FIG. 7 is a cross-sectional view of the socket housing and cartridge located about a stud in position to tighten a stud. The cross section of FIG. 7 is taken along lines C—C of FIG. 2 with the cartridge located in the socket in a position to tighten a stud. The socket housing is shown being rotated to tighten the stud. The disposition of the gripping jaws about the stud is shown, including a cross-sectional view of one of the gripping jaws.

The jaws 23 are positioned between the plates 61 and 63 to grip a stud 20 extending into the cartridge 21 through the central apertures 69A, 69B in the plates 61, 63. Each jaw 23 is located between the plates 61 and 63 extending along a portion of corresponding sides 65A and 65B of the aligned plates 61, 63. The jaws 23 are arranged about the central apertures 69A, 69B with the gripping faces 79 of the jaws 23 facing the axis extending between the apertures 69A, 69B. As shown in FIGS. 6 and 7, the circumference 22 of a stud 20 inserted through central apertures 69A and 69B may be engaged by the gripping faces 79 of the jaws.

Referring again to FIGS. 5–8, the gripping jaws 23 are slidably mounted between the plates 61 and 63 so that the jaws 23 may apply rotational force supplied to socket housing 13 and cartridge 21 by the driver translationally against the circumference 22 of the stud 20. Each jaw 23 has a guide rod aperture 93 extending through the jaw 23 from the one edge 89 to the other edge 87 of the jaw 23 adjacent the wide end 85 of the jaw. A guide rod 95 extends through the guide rod aperture 93 of each jaw 23. The guide rods 95 extend between the spaced apart plates 61 and 63. The ends 97A and 97B of the guide rods 95 are located in corresponding opposing straight or linear guide slots 99A and 99B which extend through the plates 61 and 63, respectively, along a portion of each side 65A and 65B of the plates.

Upon rotation of the socket housing 13 and cartridge 21 about a stud 20 each guide rod 95 can slide linearly along the length of the corresponding guide slots 99A and 99B in which the ends 97A and 97B, respectively, are located. Movement of each guide rod 95 in its guide slots 99A and 99B allows the jaw 23, through which the guide rod extends, to move correspondingly. The thickness differential of the wedge shaped jaws 23 is chosen to assure that the gripping faces 79 of the jaws continuously engage the circumference 22 of the stud 20 as the tool is rotated.

Figure 8:
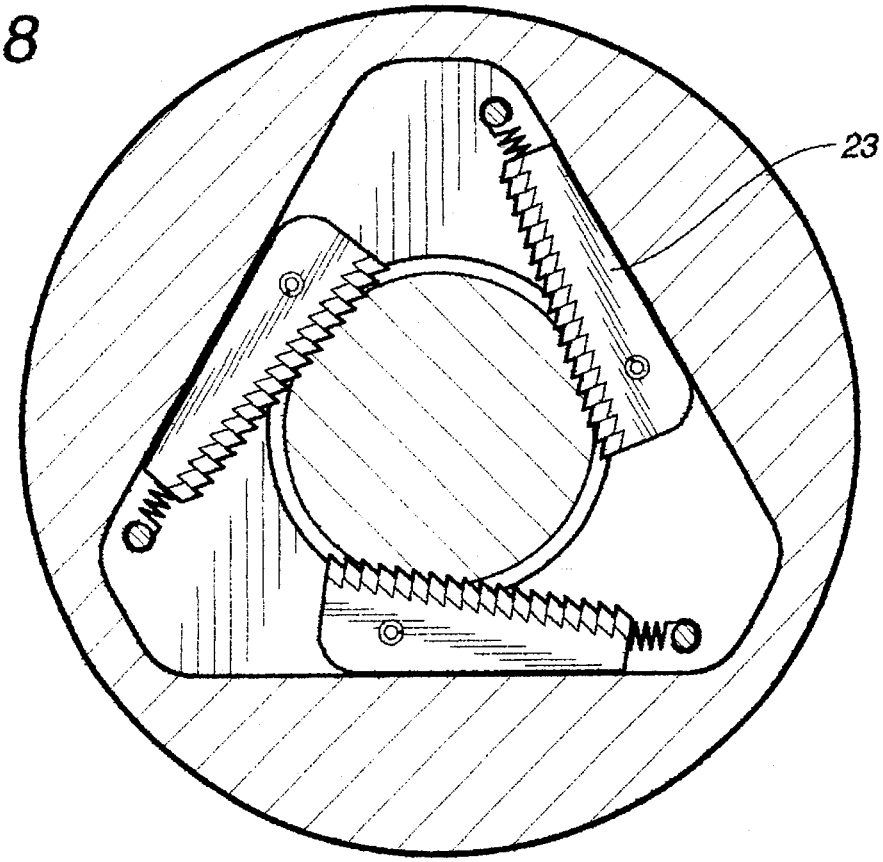
FIG. 8 illustrates the jaws of FIG. 7 in closed positions.
Figure 10:
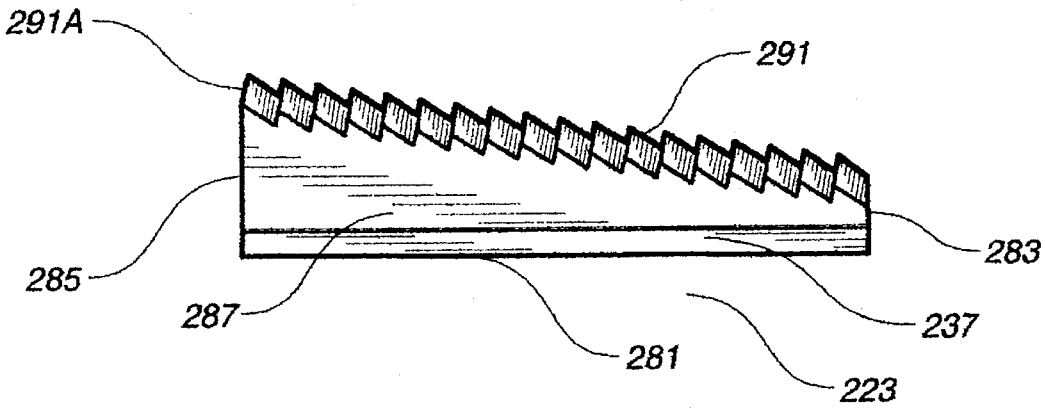
FIG. 10 is an edge view of one of the jaws of the embodiment of FIG. 9.

Springs 101 and 103 normally hold or bias the jaws 23 in pre-load or closed positions as shown in FIG. 8. The springs 101 and 103 couple each jaw 23 to a respective support rod 71 to bias the jaw and its respective guide rod 95 towards a closed position in the guide slots 99A and 99B. A portion of each spring 101 and 103 extends into a respective jaw 23 through spring apertures 105 and 107, respectively. Spring apertures 105 and 107 are located extending parallel in the jaw 23 through the narrow end 83 of the jaw. End loops 109A and 111A of the springs 101 and 103, respectively, secure springs 101 and 103 within the jaw 23 about spring support dowels 113 and 115, respectively. Spring support dowels 113 and 115 are secured in dowel apertures 117 and 119, respectively, which extend into sliding face 81 of the jaw 23 to transversely intersect the upper and lower spring apertures 105 and 107, respectively. End loops 109B and 11 1B of the springs 101 and 103, respectively, secure the springs 101 and 103 about the support rod body 73.

Support rod apertures 77A, 77B and guide slots 99A, 99B are positioned relatively in the plates 61 and 63 to locate the support rods 71 and the guide rods 95 in relative positions so that each jaw 23 may slide between a corresponding side 65A and 65B of the plates. Each plate 61 and 63 has an identical number of support rod apertures 77A and 77B, respectively, which are located opposing corresponding apertures 77A and 77B in the opposite plate 61 or 63 when sides 65A and 65B of the plates are aligned. Each aperture 77A and 77B is located along a side 65A and 65B, respectively, near a corner 67A or 67B in a plate 61 or 63. Support rods 71 extend between the apertures 77A and 77B near the corners 67A and 67B of the plates.

Each plate 61 and 63 also has an identical number of guide slots 99A or 99B which are located opposing corresponding guide slots 99A or 99B in the opposite plate 61 or 63 when sides 65A and 65B of the plates are aligned. Each guide slot 99A and 99B extends parallel to a side 65A or 65B of a plate 61 or 63, respectively, adjacent the side of the plate. Each guide slot 99A and 99B extends from a first end 121A located centrally along a side 65A or 65B of a plate 61 or 63, to a second end 121B located near a corner 67A or 67B of the plate 61 or 63. Guide rods 95 extend between corresponding guide slots 99A and 99B, and may slide between the first and second ends 121A and 121B of the guide slots 99A and 99B.

Each jaw 23 may slide between corresponding sides 65A and 65B of the plates 61 and 63 a distance equal about to the length of the slots 99A, 99B. Each jaw 23 is urged to a rest or closed position by the springs 101 and 103 when such that the narrow end 83 of the jaw 23 is located proximate to the support rod 71 to which its springs 101 and 103 are coupled, and the guide rod 95 extending through the jaw 23 is located at the first ends 121A of corresponding guide slots 99A and 99B. The ends 121A of corresponding guide slots 99A and 99B are separated from corresponding support rod apertures 77A and 77B, respectively, by a distance approximately the length of a jaw 23 from the narrow end 83 of the jaw to the guide rod aperture 93 in the jaw.

The springs 101 and 103 are extended when the guide rod 95 extending through the jaw 23 is displaced from the first ends 121A of the guide slots 99A and 99B. The extended springs 101 and 103 exert force on the jaw 23 to cause the jaw to return to its closed position when there is no stud 20 located between the jaws. In the closed positions of the jaws as shown in FIG. 8, the radius of the circle shown between the jaws is less than the radius of the circled stud portion shown between the jaws of FIGS. 6 and 7.

As shown in FIGS. 6 and 7, the faces 81 of the jaws 23 are located adjacent the inner walls 45W of the socket housing 13 when cartridge 21 is located in the housing. The face 81 of each jaw 23 and the inner wall 45W of the housing 13 are slidably engaged along a substantial portion of the face 81. The inner walls 45W supports the jaws 23 against the stud 20 as the faces 81 and the inner walls 45W move relative to each other in response to rotation of cartridge 21 for gripping a stud 20.

Referring now to FIGS. 1, 2, 6, and 7, the cartridge 21 may be reversibly located in the socket housing 13 so that the gripping jaws 23, support rods 71, springs 101 and 103, guide rods 95 and guide slots 99A and 99B may be oriented to loosen or tighten the stud 20. The plate 61 of the cartridge 21 may be located in the cavity 19 on the shoulder 41 with plate 63 located adjacent retaining plate 25, or, as described above, the plate 63 may be located on shoulder 41 with plate 61 adjacent retaining plate 25. As shown in FIG. 6, the cartridge 21 is located in the socket housing 13 in a position to loosen the stud 20 upon counterclockwise rotation of the housing 13. As shown in FIG. 7, the cartridge 21 is located in the socket housing 13 in a position to tighten the stud 20 upon clockwise rotation of the housing 13.

In operation, as shown in FIGS. 1, 6, and 7, tool 11 is provided with cartridge 21 installed in cavity 19 secured by retaining plate 25 and snap ting 27. The sides 65A and 65B of plates 61 and 63, respectively, and faces 81 of jaws 23 are located adjacent inner walls 45W of the socket housing 13. The jaws 23 are held in their closed positions by the springs 101 and 103 as shown in FIG. 8 with guide rods 95 located at the ends 121A of guide slots 99A and 99B. Shank 29 is coupled to a driver (not shown) with pin 37 which is held in place by the O-ring 39. Assume that a stud 20 is to be removed by the tool of the invention and the cartridge 21 is shown in the position of FIG. 6 with the plate 61 and the edges 87 of the jaws 23 facing outward of the housing cavity 19. As indicated above, the view of FIG. 6 is taken through lines C—C of FIG. 2. The stud 20 has male threads at one end which is screwed into a threaded aperture of a structure. The stud normally will have a chamfered or beveled ends. This chamfer of its free end plus the chamfer 91A of the jaws 23 enable the free end of the stud to push the jaws from their closed position wide enough to allow the stud to be inserted into the cavity 19 of the socket 13 between the jaws. The serrations of the beveled edge 91B when engaged by the stud 20 help force the jaws open. Any exposed threaded end portion of the stud 20 protrudes through central aperture 69B into collar bore 49 and cylindrical bore 31 (See FIG. 2) to hold it in concentric alignment.

The driver is used to rotate the tool 11. When the driver rotates tool 11 counter-clockwise as shown in FIG. 6, socket housing 13 rotates causing cartridge 21 initially to be rotated relative to the stud 20. The polygonal shape of inner wall 45 of housing 13 and the cartridge 21 prevents the housing 13 from rotating relative to the cartridge 21.

As the housing 13 continues to rotate, the inner walls 45W of the housing 13 initially slide along the outer walls 81 of the jaws 23 as shown by arrows 45WA causing the jaws to move in the directions of the arrows 23A which causes the jaws 23 to be wedged between the walls 45W and the stud 20 and their teeth 91 to bite into the stud until the stud starts to rotate counter-clockwise and unscrew from the threads of the aperture of the structure. The direction in which the teeth 91 point (toward the large ends of the jaws) facilitate movement of the jaws to the wedging positions. The tool may be removed from the stud after it has been unscrewed, by rotating the housing clockwise relative to the stud, to slide the walls 45W clockwise relative to the walls 81 of the jaws 23 to release the gripping force of the jaws 23 against the stud. The stud then can be moved longitudinally from the cavity 19 and from between the jaws 23.

If the tool is to be used to screw a stud into a threaded aperture, the cartridge 21 is reversed in position in the cavity 19 of housing 13 from that of FIG. 6 to that of FIG. 7. The stud may be manually screwed into the aperture to start the screwing process and the stud end then inserted into the cavity 19 between the jaws and the housing 13 and cartridge 21 rotated clockwise to cause the jaws to wedge against the stud and then to rotate and screw the stud into the aperture. The action of the walls 45W and the jaws 23 is the same as that described with respect to FIG. 6, but the rotation of the tool is clockwise. The tool may be released from the stud by rotating the tool counter-clockwise to release the jaws from the stud to allow the tool to be removed longitudinally from the stud.

All of the components of the tool of FIGS. 1–8 except the O-ring 39, may be formed of suitable metal.

Since the bearing surfaces 81 of the jaws 23 and the engaging walls 45W of the socket are straight or linear, sets of jaws 23 with different lengths and different angles between their gripping faces 79 and bearing surfaces 81 may be used in the tool to allow the tool to be used to remove or screw studs of different diameters. Jaws of different dimensions may be used in the tool by removing the cartridge 21 from the tool; disassembling the cartridge; replacing the set of jaws 23 with another set of jaws of different dimensions; reassembling the cartridge and replacing it in the cavity 19. The tool also has advantages in that it can be used to unscrew or screw a stud from or into a threaded aperture by reversing the position of the cartridge 21 in the cavity.

Figure 9:
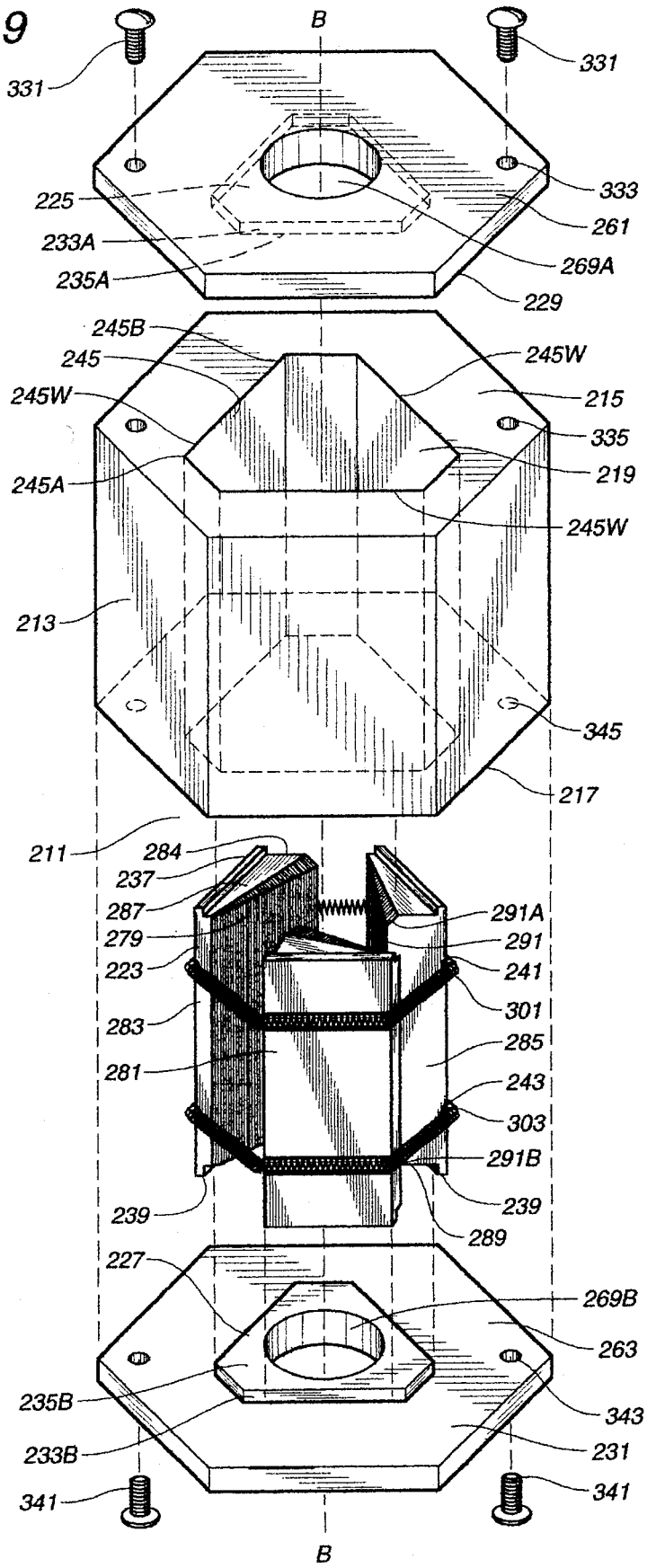
FIG. 9 is an exploded view of the another embodiment of the stud removing tool of the present invention.

Referring to FIG. 9, another embodiment of the present invention is shown. Tool 211 has a hexagonal shaped socket housing 213 having a longitudinal axis B extending between an end 215 and an end 217 of the housing 213. A cavity 219 is formed in the housing 213 extending along axis B. End 215 is open to permit access to cavity 219 by a stud (not shown). Socket housing 213 has a polygonal inner wall 245 comprising straight or linear walls 245W which extends between end 215 and end 217 of housing 213 located about axis B. Inner wall 245 extends about and defines cavity 219.

Plates 261 and 263 couple the housing 213 about the ends 215 and 217, respectively. Plates 261 and 263 have a hexagonal shape that corresponds to and is aligned with the hexagonal socket housing 213. Central apertures 269A and 269B extend through the plates 261 and 263, respectively. The central apertures 269A and 269B permit a stud to be inserted into cavity 219 through plates 261 and 263.

Raised platforms 225 and 227 extend about central apertures 269A and 269B, respectively along inner surfaces 229 and 231 of plates 261 and 63, respectively. Straight or linear platform sides 233A and 233B extend transversely between platform surfaces 235A and 235B and inner surfaces 229 and 231 of plates 261 and 263, respectively. Raised platforms 225 and 227 are shaped corresponding to polygonal inner wall 245 so that platforms 225 and 227 are located extending into cavity 219 with platform sides 233A and 233B spaced from and extending along the inner wall 245 close to the inner walls 245W.

Identical gripping jaws 223 are locatable in cavity 219 extending about axis B in position to cooperatively grip a stud extending into cavity 219 through central apertures 269A and 269B to tighten or loosen the stud in an object. Each gripping jaw 223 is a wedge shaped block having a gripping face 279 and a straight or linear slidable face 281 joined by a narrow end 283, a wide end 285, and edges 287 and 289. The gripping face 279 of each jaw 223 extends at an acute angle with respect to the face 281 of the jaw 223. A plurality of ridged teeth 291 extend along the gripping face 279 for gripping a stud. The distance between ends 283 and 284 along face 281 is less than the distance between edges 245A and 245B of the walls 245 of the housing 213. Straight or linear guide rails 237 and 239 extend outward from edges 287 and 289, respectively, along the face 281 of each jaw. Each jaw 223 has serrated chamfered or beveled edges 291A and 291B formed between teeth 291 and edges 287 and 289 respectively. The teeth 291 point toward the wide end 285 of the The guide rails 237 and 239 of each gripping jaw 223 support the gripping jaw in the cavity 219. Each gripping jaw 223 is located between the platforms 225 and 227 with the face 281 of the jaw located adjacent the inner walls 245W of the socket housing 213 and the gripping face 279 of the jaw located facing axis B so that the gripping face 279 may engage a stud inserted into the cavity 219 through central apertures 269A and 269B. The guide rail 237 of each gripping jaw 223 is located extending between a platform side 233A and an inner wall 245W while the guide rail 239 of the gripping jaw is located extending between a corresponding opposing platform side 233B and an inner wall 245W. The guide rails 237 and 239 support the gripping jaws 223 between the platforms 225 and 227.

The gripping jaws 223 can slide along the corresponding opposing platform sides 233A and 233B. Guide rails 237 and 239 can cooperatively slide between the corresponding opposing platform sides 233A and 233B, respectively, and the inner walls 245W along the platform sides 233A and 233B. The top and bottom edges 287 and 289 of each jaw 223 are slidably located against platform surfaces 235A and 235B, respectively. The face 281 of each jaw 223 is located to slidably engage an inner wall 245W. The thickness differential between the face 281 and the gripping face 279 of each jaw 223 is chosen to assure that the gripping face 279 of the jaw will engage the circumference of the stud as the jaws are wedged against the stud.

Springs 301 and 303 extend about the gripping jaws 223 to apply tension to the jaws to urge the jaws to their closed positions.

Each gripping jaw 223 has grooves 241 and 243 formed in the face 281 of the jaw for accepting springs 301 and 303, respectively. Grooves 241 and 243 extend across the face 281 of the jaw 223 from the narrow end 283 to the wide end 285 of the jaw. Springs 301 and 303 are located in grooves 241 and 243, respectively, of each jaw 223 so that spring 301 tightly encircles the gripping jaws about a portion of the jaws and spring 303 tightly encircles the jaws about a spaced portion of the jaws. The springs 301 and 303 in the grooves 241 and 243, respectively, hold the upper and lower guide rails 237 and 239 of the jaws 223 against the platform sides 233A and 233B and normally holds or urges the jaws 223 in closed positions.

Springs 301 and 303 may be replaced by an elastomeric material that fits into grooves 241 and 243 and tightly encircles the jaws 223.

The assembly 211 may be located in a housing similar to that of housing 13 of FIG. 1 but having an hexagon shaped cavity for receiving the assembly. Assume that the tool 211 is located in the cavity of a housing 13 as shown in FIG. 1 with the plate 261 and the edges 287 of the jaws 223 facing outward and the tool is to be used to unscrew a stud. The plate 25 of FIG. 1 is used to hold the tool 211 in place in the cavity. The stud may be inserted between jaws 223 from plate 261 and the tool rotated with a driver counter-clockwise to unscrew the stud. As the tool 211 is rotated, the walls 245W initially slide along surfaces 281 of the jaws 223 and cause the jaws to bite into the stud in the same manner as described in connection with FIG. 6. Continued rotation of the tool causes the teeth of the jaws to wedge into the stud until the stud starts to rotate and unscrew. The tool may be removed from the stud after it has been unscrewed by rotating the tool clockwise to release the jaws from the stud.

If the tool is used to screw a stud into a threaded aperture, the tool 11 is reversed in position in the cavity of the housing 13 and the tool rotated clockwise to cause the jaws to grip and screw the stud into the aperture.

The tool 211 of FIG. 8 also may be made small enough to be used in the cavity of a conventional socket wrench. In this embodiment the plate 261 can be secured to the end 215 of the housing 213 with screws 331 located through apertures 333 formed through plate 261 and screwed into threaded apertures 335 formed in end 215. In addition, plate 263 can be secured to the end 217 of housing 213 with screws 341 located through apertures 343 formed through plate 263 and screwed into threaded apertures 345 formed in end 217. The tool 211 can be inserted in the socket wrench to unscrew a threaded member or reversed in the socket wrench to screw a threaded member into a threaded aperture.

All of the components of the tool of FIG. 9 may be formed of suitable metal.

Since the bearing surfaces 281 of the jaw 223 and the engaging walls 245W of the socket are straight or linear, sets of jaws 223 with different lengths and different angles between their gripping faces 279 and bearing surfaces 281 may be used in the tool to allow the tool to be used to remove or screw studs of different diameters. Jaws of different dimensions may be used in the tool by removing the assembly from the socket disassembling the assembly 211; replacing the set of jaws 223 with another set of jaws of different dimensions; reassembling the assembly 211 and replacing it in the socket.

The tool also has advantages in that it can be used to unscrew or screw a stud from or into a threaded aperture by reversing the position of the jaws in the socket.

The foregoing disclosure and the showings made in the drawings are merely illustrative of the principles of this invention and are not to be interpreted in a limiting sense.

I claim:

1. A tool for applying rotational force to a threaded member, comprising:

a socket having a surrounding wall defining an opening leading to a cavity with a plurality of inner side walls spaced about a longitudinal axis extending through said cavity, and having opposite ends with an opening at each end leading to said cavity;

a plurality of jaws equal in number to said plurality of inner side walls adapted to be located in said cavity;

each jaw of said plurality of jaws having opposite facing edges, an outer bearing surface, and an inner gripping surface with each said jaw wedge shaped in cross-section through said outer bearing and said inner gripping surfaces;

spaced apart opposite end wall members with aligned central apertures formed therethrough for slidably supporting said opposite edges of said jaws for movement between first and second positions along straight paths with each bearing surface engaging an inner side wall of said plurality of inner side walls of said socket when said jaws are located in said cavity with an opening formed between said inner gripping surfaces of said jaws for receiving said threaded member;

in said second positions of said jaws, an opening formed between said jaws being greater than another opening formed between said jaws when said jaws are in said first positions;

each of said opposite wall members having a plurality of guide surfaces on one side equal in number to the number of said jaws and located around said central opening;

each of said jaws further having a slide surface formed on said opposite facing edges;

means for securing said opposite wall members to opposite ends of said socket respectively with said guide surfaces facing inward such that a plurality of pairs of guide surfaces are formed with said jaws located between said wall members with said slide surfaces of each jaw engaging one of said pairs of guide surfaces for guiding said jaws for slidable movement along said straight path between said opposite wall members;

guide means for guiding said jaws for movement along said straight paths;

tension means for normally urging said jaws to said first positions and allowing said threaded member to be inserted between said jaws; and means for holding said jaws in said cavity such that when said threaded member is located between said jaws, rotation of said socket in a given direction causes said side walls of said socket to apply rotational torque to said outer bearing surfaces of said jaws to cause said inner gripping surfaces of said jaws to grip and rotate said threaded member.

2. The tool of claim 1, wherein:

each of said jaws comprises first and second opposite ends with said second end being larger in cross-section through said outer and inner surfaces than said first end and with said jaws located in said cavity such that around said longitudinal axis, said second end of one jaw is located adjacent said first end of a next jaw of said plurality of jaws, each of said jaws have teeth on its said inner gripping surface which point toward its said second end.

3. The tool of claim 2 wherein:

said jaws may be reversed in position in said cavity to allow said jaws to screw or unscrew said threaded member into or from threads of an aperture.

4. The tool of claim 3 wherein:

each of said jaws has serrated chamfered edges formed between said inner gripping surface and said opposite facing edges.

5. The tool of claim 1 comprising:

said opposite end wall members each has a plurality of elongated slots formed therethrough equal in number to the number of said jaws, rod means for supporting said opposite end wall members at spaced apart positions such that each of said slots of one of said wall members is aligned with a slot of the other of said wall members to form a plurality of pairs of aligned slots, each of said jaws having an aperture formed therethrough between its said opposite edges, and a rod extending through each of said apertures of each of said jaws and located in one of said pairs of aligned slots for guiding said jaw for slidable movement along said straight path between said opposite wall members.

6. The tool of claim 5, wherein:

each of said jaws comprises first and second opposite ends with said second end being larger in cross-section through said outer and inner surfaces than said first end and with said jaws located in said cavity such that around said longitudinal axis, said second end of one jaw is located adjacent said first end of a next jaw of said plurality of jaws, each of said jaws have teeth on its said inner gripping surface which point toward its said second end.

7. The tool of claim 5 wherein:

said jaws may be reversed in position in said cavity to allow said jaws to screw or unscrew said threaded member into or from threads of an aperture.

8. The tool of claim 7 wherein:

each of said jaws has serrated chamfered edges formed between said inner gripping surface and said opposite facing edges.

9. A tool for applying rotational force to a threaded member, comprising:

a socket having a surrounding wall with opposite ends defining opposite openings leading to a cavity with a plurality of inner side walls spaced about a longitudinal axis extending through said cavity, two spaced apart opposite end wall members each having a central aperture formed therethrough, each of said end wall members having a plurality of guide edges equal in number to the number of said inner side walls, means for removably coupling said two opposite end wall members to said opposite ends of said socket respectively with said central apertures aligned and said guide edges of said end wall members facing inward and aligned respectively to form a plurality of pairs of aligned guide edges, a plurality of jaws equal in number to the number of said inner side walls, each jaw having opposite facing edges, an outer bearing surface, and an inner gripping surface with each jaw being wedge shaped in cross-section through said outer and inner surfaces, each of said jaws comprising a slide surface formed on its said opposite facing edges, said jaws being located in said cavity with said slide surfaces of each jaw engaging a pair of aligned guide surfaces of said end wall members to slidably support said jaws in said cavity between said opposite end wall members for movement between first and second positions with said bearing surfaces engaging said inner walls and said gripping surfaces facing inward with an opening formed between said gripping surfaces of said jaws for receiving said threaded member, in said second positions of said jaws, an opening formed between said jaws being greater than another opening formed between said jaws when said jaws are in said first positions, tension means for normally urging said jaws to said first positions and allowing said threaded member to be inserted between said jaws such that rotation of said socket in a given direction causes said side walls of said socket to apply rotational torque to said outer bearing surfaces of said jaws to cause said gripping surfaces of said jaws to grip and rotate said threaded member, said jaws being locatable in said cavity in a first position to allow said jaws to be rotated in said given direction to unscrew said threaded member from a threaded aperture and being locatable in said cavity in a second position opposite said first position to allow said jaws to be rotated in a direction opposite said given direction to screw said threaded member into said threaded aperture.

* * * * *